United States Patent [19]

Seymour

[11] 3,976,297

[45] Aug. 24, 1976

[54] RETURNING TETHERED DISC

[76] Inventor: William D. Seymour, 1100 NE. 160th St., North Miami Beach, Fla. 33162

[22] Filed: June 27, 1975

[21] Appl. No.: 591,132

[52] U.S. Cl. ..... 273/95 A; 273/106 B; 273/102 R; 46/51; 46/74 D

[51] Int. Cl.[2] ..... A63B 71/00

[58] Field of Search..... 46/51, 74 R, 74 D, 52; 273/95 A, 106 R, 106 B, 101, 102 R, 95 R, 58 C; 272/1 B

[56] References Cited

UNITED STATES PATENTS

| | | | |
|---|---|---|---|
| 2,269,941 | 1/1942 | Jones | 273/106 B |
| 3,590,518 | 7/1971 | LeBaron | 273/106 B |
| 3,655,190 | 4/1972 | Lemon | 273/95 A |
| 3,724,122 | 4/1973 | Gillespie | 273/106 B |
| 3,764,140 | 10/1973 | Lotpy | 273/58 C |
| 3,802,117 | 4/1974 | Engelhardt | 46/74 D |
| 3,895,801 | 7/1975 | Baird | 273/106 B |

OTHER PUBLICATIONS

Playthings, 3/71, p. 145.

*Primary Examiner*—Richard C. Pinkham
*Assistant Examiner*—Marvin Siskind

[57] ABSTRACT

The present invention pertains to a saucer like disc type of toy which is rotatably attached to one end of a monofilament or nylon string. A substantial length of said string is normally stored on an operator device such as a baton or wrist band controlled by the user. In use, the user removes a substantial length or all of said string from the storage device, grasps the saucer like disc in an inverted position and throws it with a flick of the wrist. In addition to its flying movement away from the user, the disc attains a rapidly spinning movement and when the disc extends the removed length of string to its limit, the spinning disc automatically reverses its direction of flight and returns to the operator.

11 Claims, 7 Drawing Figures

RETURNING TETHERED DISC

FIELD OF THE INVENTION

The present invention pertains to a toy of a flying disc type which the operator throws outwardly, or outwardly and upwardly, with a flick of the wrist and which returns to said operator when the disc reaches the extent of a length of string from the flying disc to the operator or the vicinity of the operator. A predetermined length of string is normally stored on a device controlled by the operator and a length of said string is removed from the device prior to actuation of the disc; the removed length of string determines the length of flight of the disc. When the disc reaches the extended length of string and returns to the operator, he or she may catch it or permit it to fly by to the extent of the string in the opposite direction. When it reaches the string extent in the opposite direction, it will, again, return to the operator.

OBJECTS AND ADVANTAGES OF THE PRESENT INVENTION

One of the principal objects of the present invention is to provide a saucer like disc shaped toy which may be thrown outwardly, away from the operator, and which then returns to said operator.

Another principal object of this invention is to provide a tether controlled at a first end by the operator and attached at its second end to the saucer shaped disc in a manner so as to permit rapid rotational movement thereof, and which permits a predetermined length of flight away from the operator before reversing the direction of flight, back to the operator.

A further object of the invention is to provide means such as a baton, wrist band, spool or the like, about which a predetermined length of tether line, preferably in the form of a monofilament or nylon line, is normally stored in a wound up or spooled condition and from which any desired length of line within said predetermined length may be unwound to determine the length of flight of the saucer.

A still further object of the present invention is to provide a toy which develops coordination in children as well as stimulating physical activity by throwing and catching the saucer shaped disc in one continuous action.

DETAILED DESCRIPTION OF THE DRAWINGS

Figure 1:
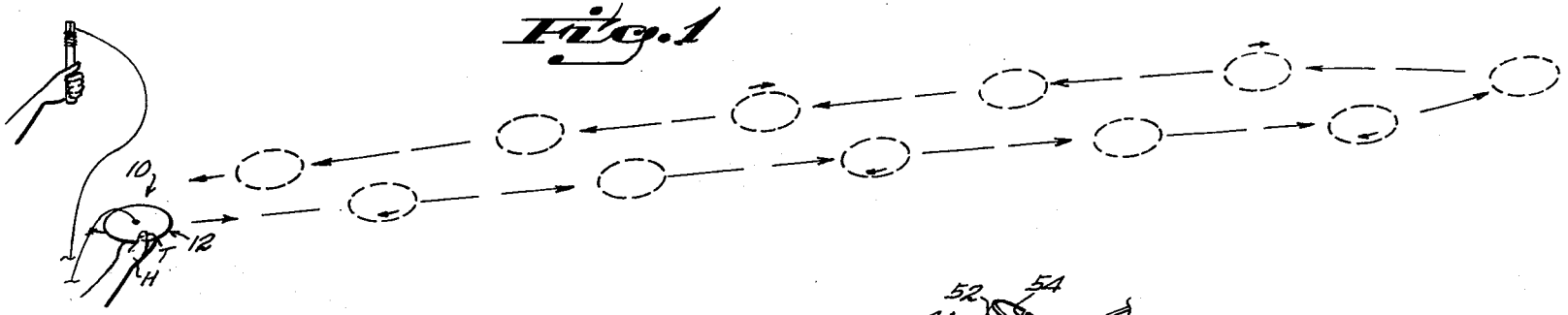
FIG. 1 is a schematic perspective view, illustrating the operation of the present invention.
Figure 2:
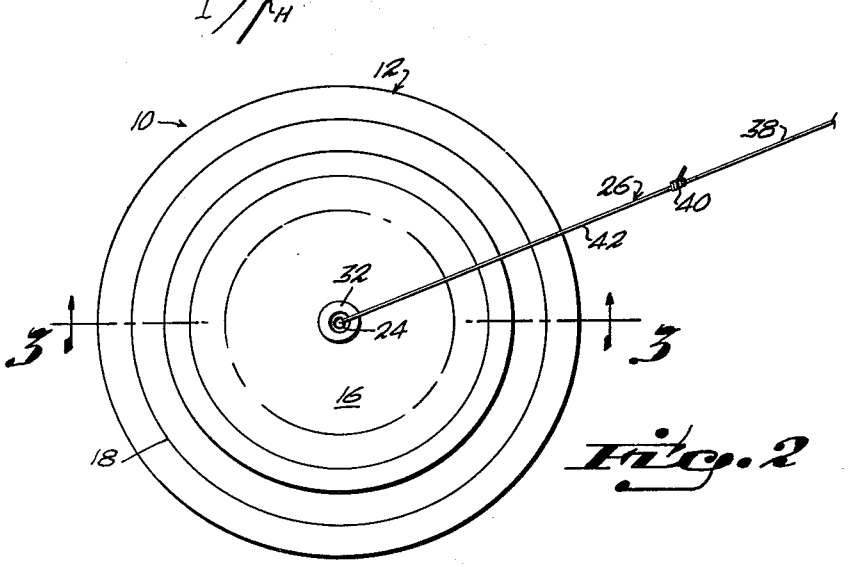
FIG. 2 is a top plan view of the flying saucer type of disc of the present invention.
Figure 3:
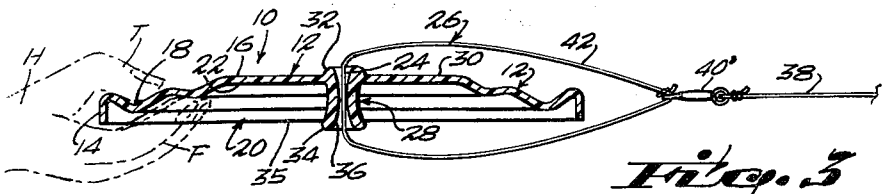
FIG. 3 is a cross sectional view taken along line 3 — 3 of FIG. 2.

With reference to the drawings in which like reference characters designate like or corresponding parts throughout the various views and with particular reference to FIGS. 1, 2 and 3, the disc like flying saucer of the present invention is designated generally at 10 and includes a main body portion 12 and an annular peripheral skirt portion 14, which normally extends generally downwardly when the toy is in use.

As best seen in FIG. 1, the main body portion 12 comprises a top wall 16 which is preferably configurated, adjacent the peripheral skirt 14, to define a downwardly depending annular rounded ridge 18 to provide a grip for the thumb tip T when the disc 10 is properly gripped by the user in one hand H. The four fingers F of the hand H extend up and around the skirt 14 into the cavity 20, defined by the top wall 16 and skirt 14, against the underside 22 of the top wall 16.

An axial through hole 24 is provided in the top wall 16 for passage therethrough of a string 26. In a preferred form of the invention, an axially extending sleeve 28 is provided from the control portion of the top wall 16. Said sleeve 28 extends upwardly of the top surface 30 of the top wall 16 as at 32, and downwardly at 34 to a point beneath the bottom annular edge 35 of skirt 14. The hole 24 extends axially through the sleeve 28 and is preferably, outwardly flared as at 36 toward the upper and lower extended sleeve ends 32 and 34.

The string 26 which is preferably of monofilament or nylon is passed through the axial hole 24 and tied at its end portion to the main string length 38 as at 40 somewhat outwardly of the skirt 14 to define a relatively loose loop 42 around one-half of the diameter of the disc.

Figure 4:
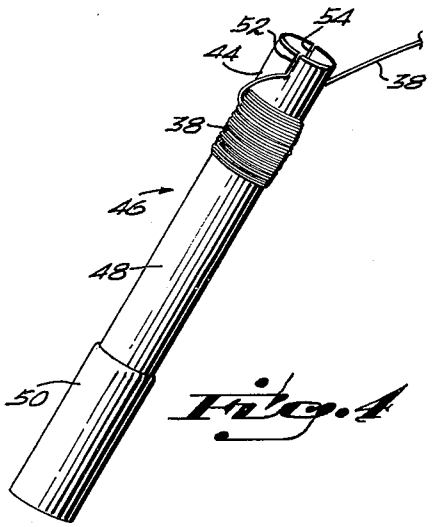
FIG. 4 is a perspective view of a baton type of control device for storing a predetermined length of control line for the saucer disc.

With reference to FIG. 4, the greater portion of the main string length 38, which is quite substantial, is normally wound or spooled around an upper end portion 44 of a control baton 46 in the form of an elongated tube 48 providing a lower end hand grip portion 50. Opposed upper end slots 52 and 54 are provided through the baton wall to receive and secure the main length of string 38 with any selected length thereof unwound and extended from the baton. Various other control devices such as a wrist band, spool or the like may be employed in place of the baton 46.

As illustrated and described relative to FIG. 3, the disc 10 is grasped in one hand and is thrown outwardly with a flick of the wrist which in combination with the loose loop connection 42, provides for a rapid spinning movement to the disc 10. When the disc 10 reaches the extended length of line 38, it reverses its direction of flight and returns to the operator. If the operator wishes, he may catch the disc 10, or permit it to fly by in the reverse direction until it again reaches the extended length of line 38 and it again reverses its direction and returns a second time to the operator.

The test strength of the monofilament or nylon line would vary according to the weight of the disc. The flying saucer disc 10 may be made in a variety of sizes, shapes and weights; for example, a light weight disc, approximately 24 inches in diameter, made of a foam type of plastic material, would achieve a higher elevation during flight by spinning the disc on an outward, upward angle. The combination of light weight and large size would cause the disc to glide further and longer, being controlled by a greater length of line. The elasticity of the monofilament or nylon line encourages the return flight to the operator.

Smaller discs formed of a more rigid, heavier plastic material will fly faster for shorter distances but may be lacking in the long distance sailing qualities of the larger, light weight discs, however, a wide range of disc sizes and types of plastic material construction can be provided to achieve any desired results.

Figure 5:
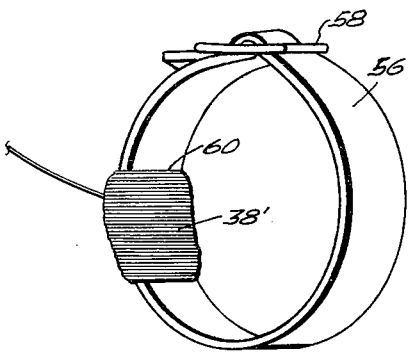
FIG. 5 is a perspective view of a modified type of control device in the form of a wrist band for storing the length of control line.

FIG. 5 illustrates a modified form of control device in the form of a wrist band comprised of a strap 56 and buckle means 58 for holding the strap around the wrist of the user. In use, the main length of line 38' is tied to and wound around one portion of the strap 56 as at 60. Prior to engaging the strap 56 about the wrist, the user unwinds a desired length of line 38' and may engage the line about the buckle 58 to firmly anchor the extended length. When the user no longer desires to play with the disc toy, the wrist band is removed and the extended length is rewound thereon.

Figures 6, 7:
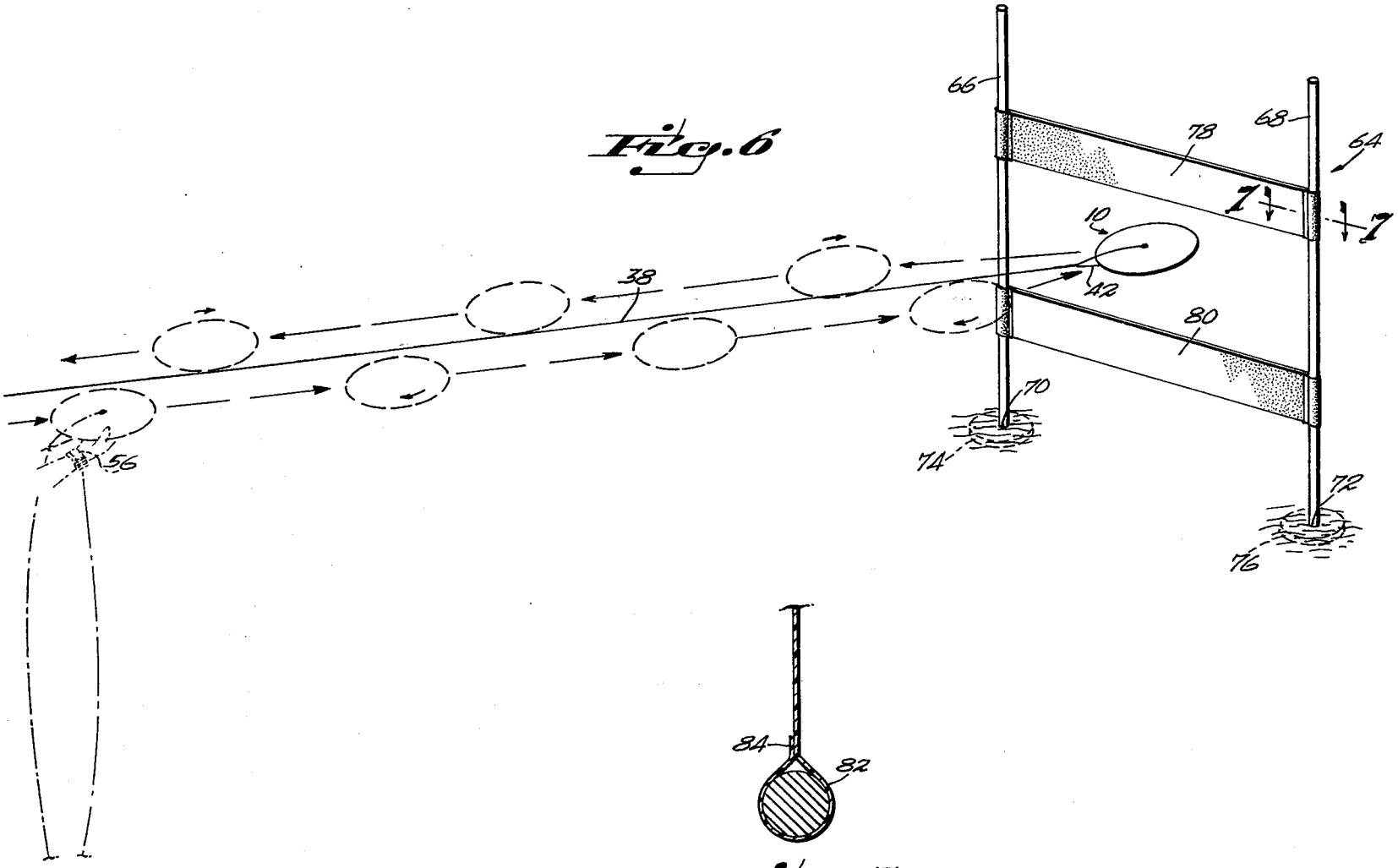
FIG. 6 is a perspective view of a target in the form of a net, for use with the disc toy.
FIG. 7 is a cross sectional view taken along line 7 — 7 of FIG. 6.

With reference to FIG. 6, a target may be provided for the operator or operators of the flying disc toy in the form of an adjustable net assembly 64. The net assembly 64 comprises a pair of poles 66 and 68 for vertical mounting relative to a support surface such as the ground. When so mounted, the lower end portions 70 and 72 could be implanted in the ground. Alternatively, respective pedestal bases 74 and 76, illustrated in broken lines, can be provided to slip on said lower end portions to support the poles 66 and 68 on the ground or on a hard surface such as black top or concrete.

Upper and lower net means, preferably in the form of thin plastic webs 78 and 80, are adjustably spaced relative to the poles 68 and 80. In use, the poles 66 and 68 are spaced apart a distance to draw the webs 78 and 80 to a relatively taut condition. The respective ends of each web 78 and 80 terminate in tubes 82 as best seen in FIG. 7. When the webs 78 and 80 are formed of plastic as indicated, the tubes 82 may be formed by heat sealed hems as at 84. The webs 78 and 80 may be adjustably spaced relative to each other by sliding the tubes 82 along the poles 66 and 68 to vary the vertical spacing therebetween. In this manner, the target net assembly 64 may be used by one person to develop his skills in operating the flying disc toy as illustrated; or two or more persons may match their skills and score in accordance with their respective abilities to place the disc between the webs 78 and 80 at any set vertical spacing therebetween.

Alternatively as shown in FIG. 3, a swivel connection 40' may be provided to connect the main string length 38 to the loop 42, to prevent twisting when winding or unwinding said main string length 38.

What is claimed is:

1. A flying toy comprising, in combination,

A. a generally disc shaped device including, 1. a top wall and
2. a peripheral downwardly extending skirt, defining a generally inverted saucer configuration, and
3. an axially extending hole through said top wall;

B. an elongated line having a first end and a second end said first end comprising a loop loosely attached to said disc shaped device, through said axial hole; and an end zone extending from said second end towards said first end; and C. control means including a first portion and a second portion, said end zone of said line being attached to said second portion.

2. The flying toy, as defined in claim 1, wherein said control means comprises a baton and said second portion comprises an upper end normally containing said major portion of spooled line, and said first portion comprises a lower hand grip portion.

3. The flying toy, as defined in claim 1, wherein said baton comprises an elongated plastic tube.

4. The flying toy, as defined in claim 3, including opposed upper end slots through the tubular wall to receive and secure the main length of said string with any selected length of said string unwound from said baton.

5. The flying toy, as defined in claim 1, wherein said disc shaped device is formed of a rigid plastic material.

6. The flying toy, as defined in claim 1, wherein said string is of a type which provides a degree of flexibility.

7. The flying toy, as defined in claim 1, wherein said control means comprises a wrist band sized for engagement about the wrist of a user.

8. The flying toy as defined in claim 7, wherein said wrist band comprises a strap for engagement about the wrist of a user and includes buckle means to maintain said strap in place on the wrist.

9. A flying toy as defined in claim 1 wherein a net assembly is provided, said net assembly comprising a target, including a pair of vertically mounted, spaced apart poles and a pair of horizontal, spaced apart web members spanning the distance between the poles.

10. The flying toy and target means as defined in claim 9 wherein the respective ends of each horizontal web are tubular for sliding engagement along the length of said poles.

11. The flying toy as defined in claim 1 wherein said control means comprises a baton having a handle portion.

* * * * *